US012575681B1

(12) United States Patent
Knabe

(10) Patent No.: US 12,575,681 B1
(45) Date of Patent: Mar. 17, 2026

(54) TILTABLE BED FRAME

(71) Applicant: Innovative Sleep Technologies LLC, St. Peters, MO (US)

(72) Inventor: Sven Knabe, Gummersbach (DE)

(73) Assignee: Innovative Sleep Technologies LLC, St. Peters, MO (US)

( * ) Notice: Subject to any disclaimer, the term of this patent is extended or adjusted under 35 U.S.C. 154(b) by 0 days.

(21) Appl. No.: 19/005,739

(22) Filed: Dec. 30, 2024

Related U.S. Application Data

(63) Continuation-in-part of application No. 29/960,317, filed on Aug. 29, 2024.

(51) Int. Cl.
*A47C 19/02* (2006.01)
*A47C 20/04* (2006.01)

(52) U.S. Cl.
CPC ..... *A47C 19/025* (2013.01); *A47C 20/041* (2013.01); *A47C 20/046* (2013.01)

(58) Field of Classification Search
CPC ... A47C 19/025; A47C 20/041; A47C 20/046; A47C 20/08; A47C 20/10; A61G 7/005; A61G 7/012; A61G 7/002
See application file for complete search history.

(56) References Cited

U.S. PATENT DOCUMENTS

| | | | | | |
|---|---|---|---|---|---|
| 2,807,174 | A * | 9/1957 | Helsel | A61G 7/015 403/339 |
| 4,715,073 | A * | 12/1987 | Butler | A61G 7/005 5/607 |
| 10,306,994 | B2 * | 6/2019 | Barr | A47C 19/025 |
| 11,399,998 | B2 | 8/2022 | Shih et al. | |
| 11,766,131 | B2 | 9/2023 | Bellingroth | |
| 2019/0328593 | A1 * | 10/2019 | Choi | A61G 7/018 |
| 2020/0078238 | A1 * | 3/2020 | Huang | A61G 7/012 |
| 2020/0187662 | A1 * | 6/2020 | Zeng | A47C 19/122 |
| 2020/0397147 | A1 * | 12/2020 | Ren | A47C 19/021 |
| 2023/0363543 | A1 * | 11/2023 | Stokesbary | A47C 20/041 |
| 2024/0197076 | A1 * | 6/2024 | Chung | A47C 19/12 |
| 2024/0260759 | A1 * | 8/2024 | Smith | A47C 20/041 |

* cited by examiner

*Primary Examiner* — Justin C Mikowski
*Assistant Examiner* — Alison N Labarge
(74) *Attorney, Agent, or Firm* — Sandberg Phoenix & von Gontard, PC

(57) ABSTRACT

An elevation kit that can support a mattress frame or mattress support is movable between a flat position in which the mattress support can be horizontal (so that the mattress can be relatively horizontal) and a raised position in which the mattress support can be canted from a first end to, The elevation kit comprises a base, a locking element, a lever member, and a tilt member. The elements of the elevation kit are structured such that the elevation kit is easily assembled from its shipped configuration by a customer/user.

9 Claims, 12 Drawing Sheets

TILTABLE BED FRAME

CROSS-REFERENCE TO RELATED APPLICATIONS

This application is continuation-in-part of co-pending application Ser. No. 29/960,317 filed Aug. 29, 2024, entitled Tiltable Bed Frame, and which is incorporated herein by reference.

STATEMENT REGARDING FEDERALLY SPONSORED RESEARCH OR DEVELOPMENT

Not Applicable.

BACKGROUND

This application relates generally an elevation kit for mountable to a bed frame to enable the bedframe to be raised.

Tiltable beds are well known. However, the bed frames can be complicated to assemble and set up. It would thus be desirable to provide an elevation kit for a bed frame that is relatively simple to assemble and set up.

BRIEF SUMMARY

Briefly stated, disclosed in an elevation kit that can support a mattress frame or mattress support, and which is movable between a flat position in which the mattress support can be horizontal (so that the mattress can be relatively horizontal) and a raised position in which the mattress support can be canted from a first end to a second end, The elevation kit comprises a base, a locking element, a lever member, and a tilt member. The elements of the elevation kit are structured such that the elevation kit is easily assembled from its shipped configuration by a customer/user.

The base comprises a head portion and a foot portion, each of which comprises an end member and opposed side members such that the head and foot portions are generally U-shaped. The side members of the head and foot portions overlap each other at their respective ends to define an overlap area of the base. A fastener extends through the side members of the foot and head portions in the overlap area to pivotally connect the foot and head portions together. The fastener defines a pivot axle for the base, whereby the base is capable of being folded in a position wherein one of the head and foot portions nests within the other of the head and foot portions.

The locking element is adapted to secure the base in an unfolded position in which the side members of the foot and head portions of the base are generally parallel and in generally the same plane.

The lever member comprises opposed lever arms and first and second transverse members extending between the opposed lever arms and which are spaced from each other along the opposed lever arms. One of the transverse members can be an upper transverse member and the other can be a lower transverse member. The lever arms are pivotally connected at their bottom ends to the side members of the base head portion between the end member of the base head portion and the overlap area of the base. The lever member further includes a roller proximate a free end of each arm.

The tilt member comprises a pair of opposed tilt member arms and an end member extending between the tilt member arms at a head end of the tilt member arms. The tilt member arms are shorter the overall length of the base. Each tilt member arm includes an inwardly facing track extending rearwardly from the tilt member end member which is sized to receive the rollers of the lever member, and the rollers of the lever member are thus received in the tracks.

The drive assembly comprises an extendable/retractable member which is pivotally connected at one end to the base and is pivotally connected at a second end to the tilt member. Activation of the drive assembly causes a length of the extendable/retractable member to alter thereby adjusting an angular position between the tilt member and the base.

In accordance with an aspect of the elevation kit, the locking member comprises a pin which extends through the side members of the head and foot portions of the base in the overlap area.

In accordance with an aspect of the elevation kit, the tilt member arms are approximately equal in length to the length of the side members of the base head portion.

In accordance with an aspect of the elevation kit, the drive assembly is pivotally connected at its first end to the end member of the head portion and is pivotally connected at its second end to the first transverse member of the lever member.

In accordance with an aspect of the elevation kit, including a lever arm extending from the first transverse member, wherein the second end of the drive assembly is pivotally connected to the lever arm.

In another aspect, a tiltable bed frame is disclosed comprising the elevation kit as described above and a mattress support member, the mattress support member being adapted to be secured to the elevation kit and to support a mattress.

In accordance with an aspect of the tiltable bed frame, the mattress support member is adjustable. In this instance, the mattress support comprises a mattress support frame having a head portion and a foot portion which are pivotally connected, whereby the head and foot portion of the mattress support frame can be pivoted about a pivot axis between a folded position and an open position. The mattress support member further includes at least a mattress support head section and a mattress support foot section which in combination define a surface adapted to support a mattress. The mattress support head section is positioned over the head portion of the mattress support frame and the mattress support foot section is positioned over the foot portion of the mattress support frame.

In accordance with an aspect of the tiltable bed frame, at least one of the mattress support head and foot sections is adapted to be pivotal between a lowered position in which it is generally parallel to the support frame and a raised position in which it is angled relative to the support frame. Preferably, both the mattress support head and foot sections are pivotal between the respective lowered and raised positions.

In accordance with an aspect of the tiltable bed frame, at least one of the mattress support head and foot sections is shorter than its respective head and foot portion of the support frame; the mattress support member further comprising a mattress support middle section positioned between the mattress support head and foot sections such that the mattress support middle section does not extend over the pivot axis.

BRIEF DESCRIPTION OF THE DRAWINGS

Corresponding reference numerals will be used throughout the several figures of the drawings.

DETAILED DESCRIPTION

Figure 1:
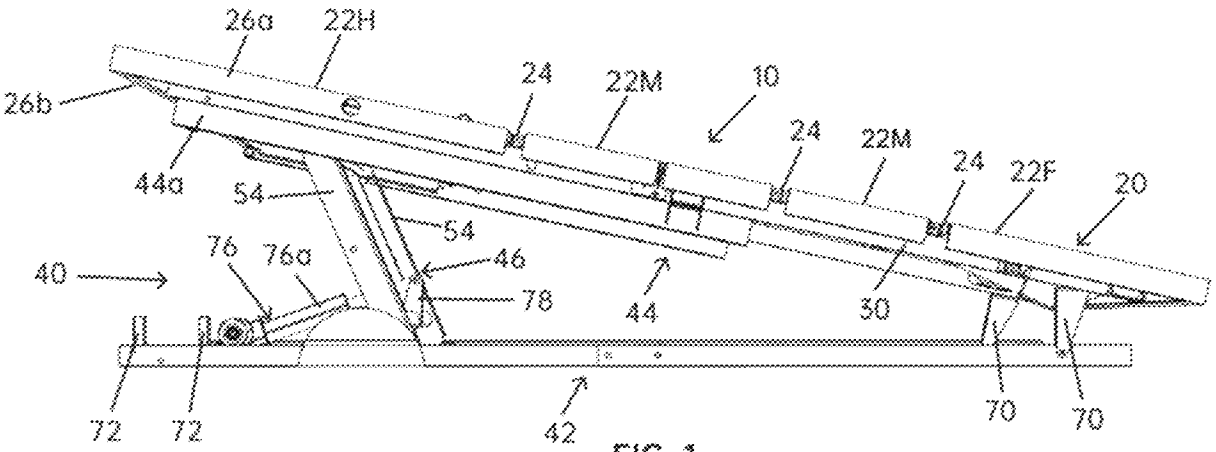
FIG. 1 is a side elevational view of a tiltable bed frame, in a raised position, the bed frame comprising an elevation kit and a mattress support.
Figure 2:
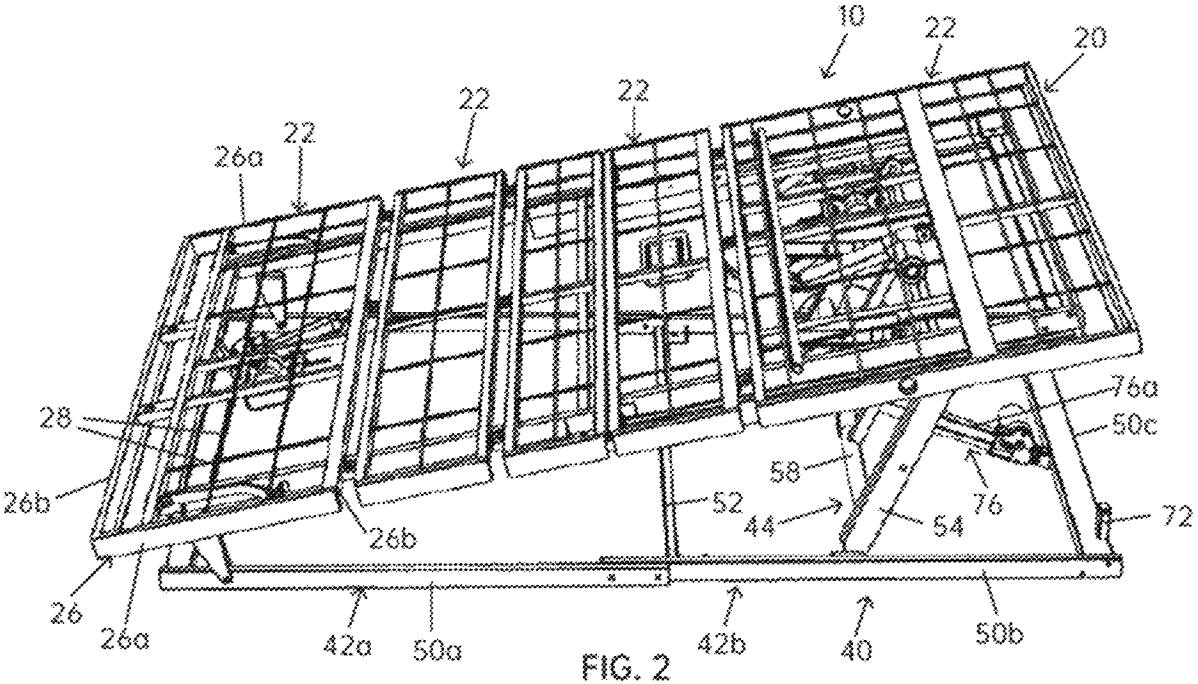
FIGS. 2 and 3 are top and bottom perspective views the tiltable bed frame in the raised position.
Figure 3:
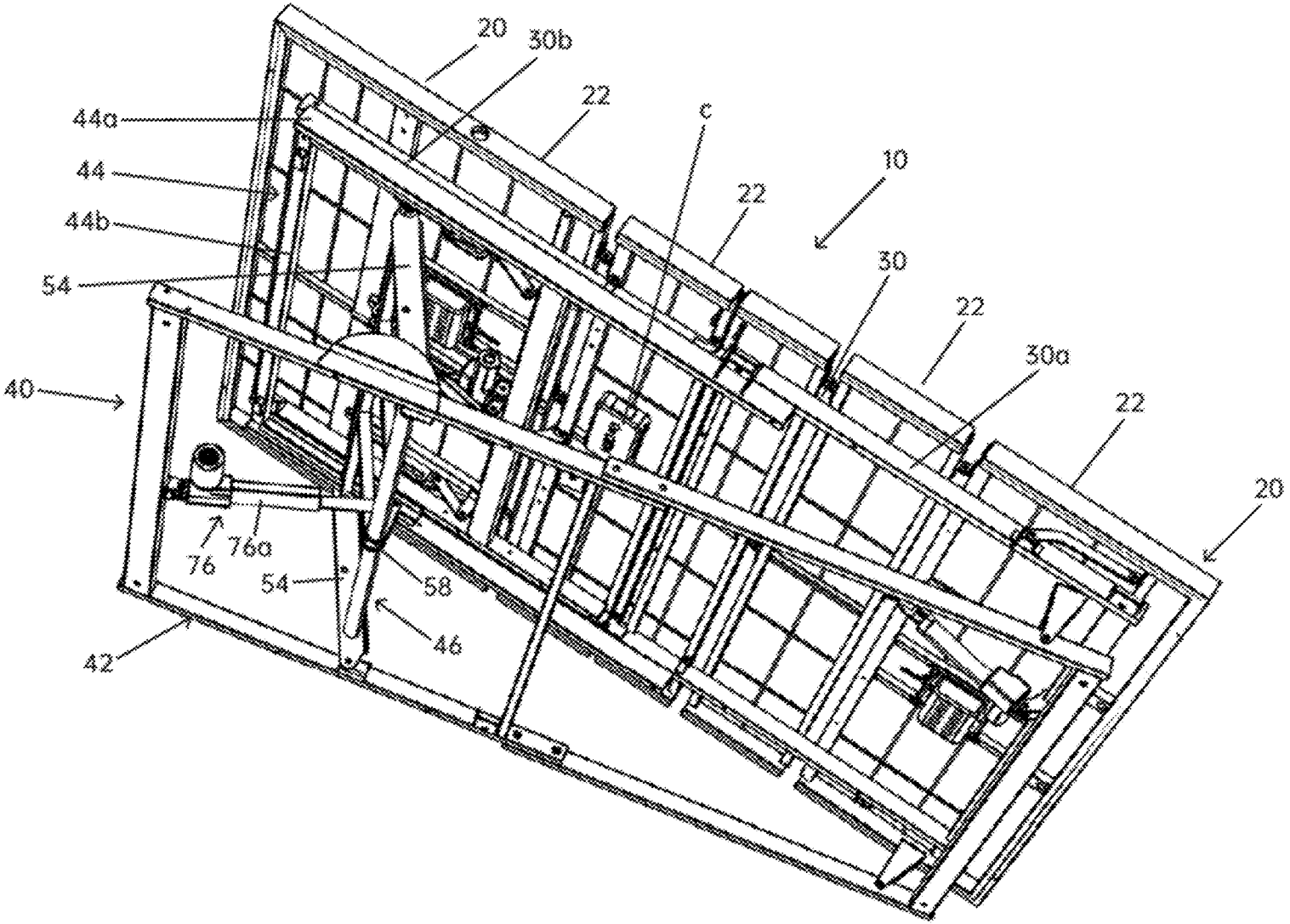
Figure 4:
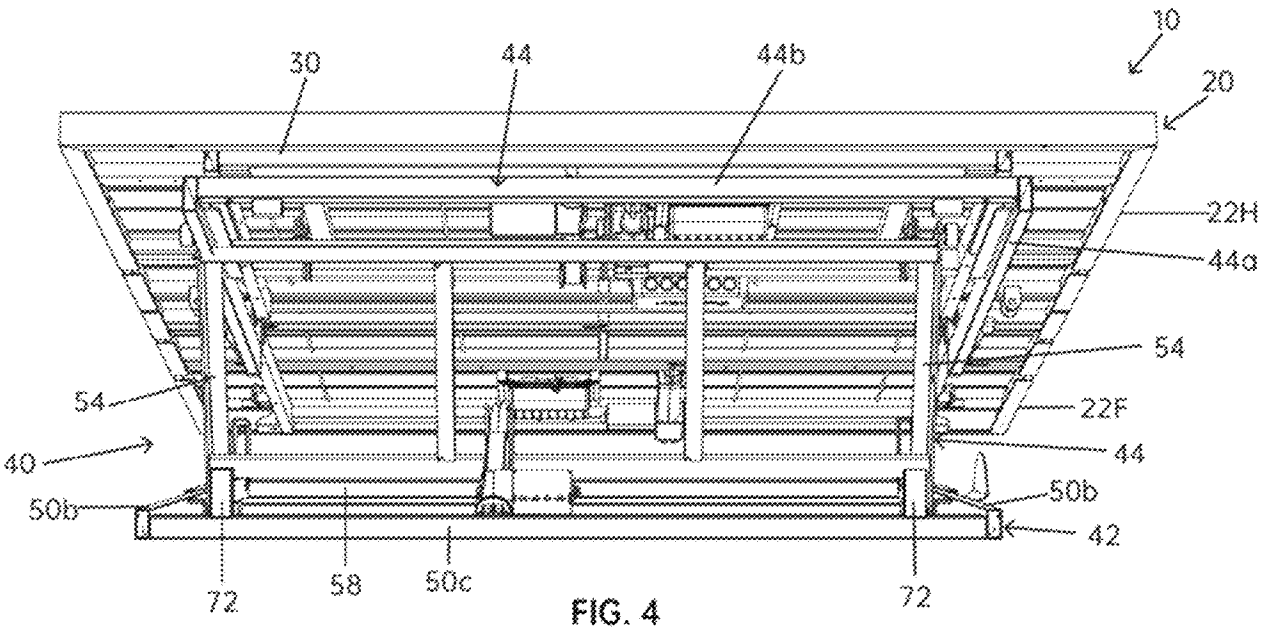
FIGS. 4-5 are front (or head) and rear (or foot) elevational views of the bed frame in the raised position.
Figure 5:
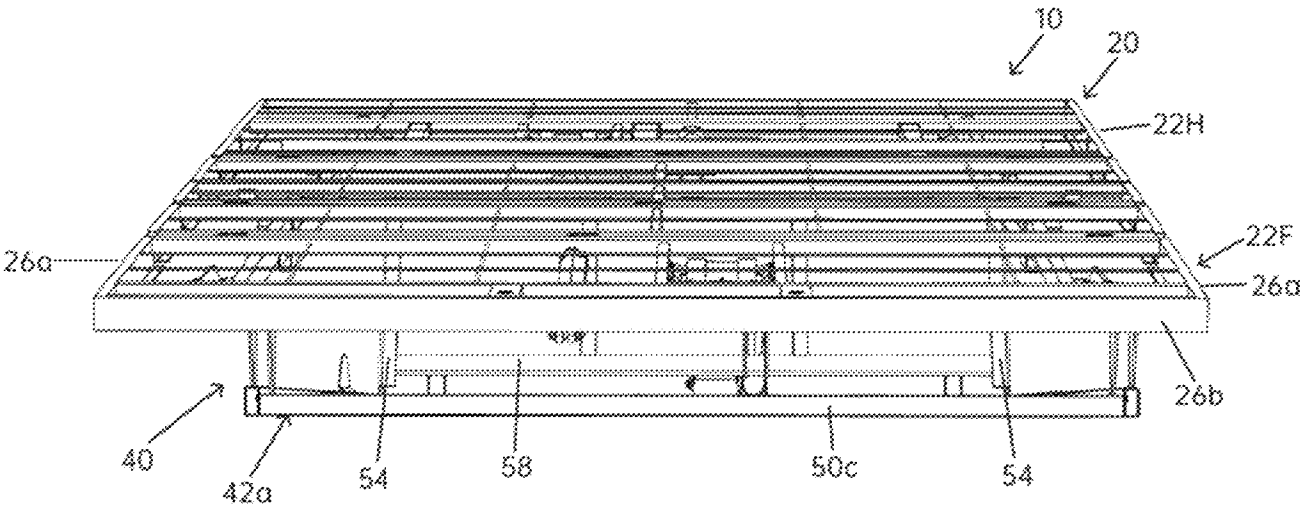
Figure 6:
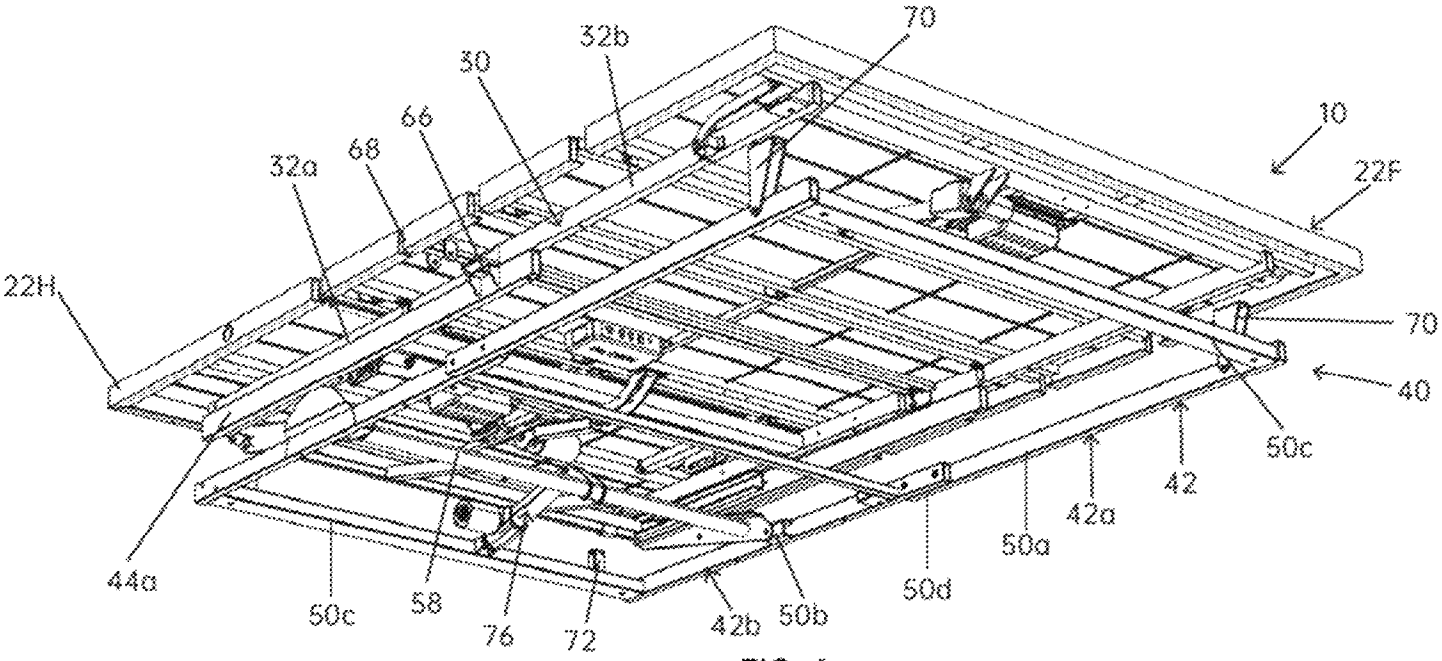
FIGS. 6 and 7 are bottom and top perspective views, respectively, of the bed frame in a flat position.
Figure 7:
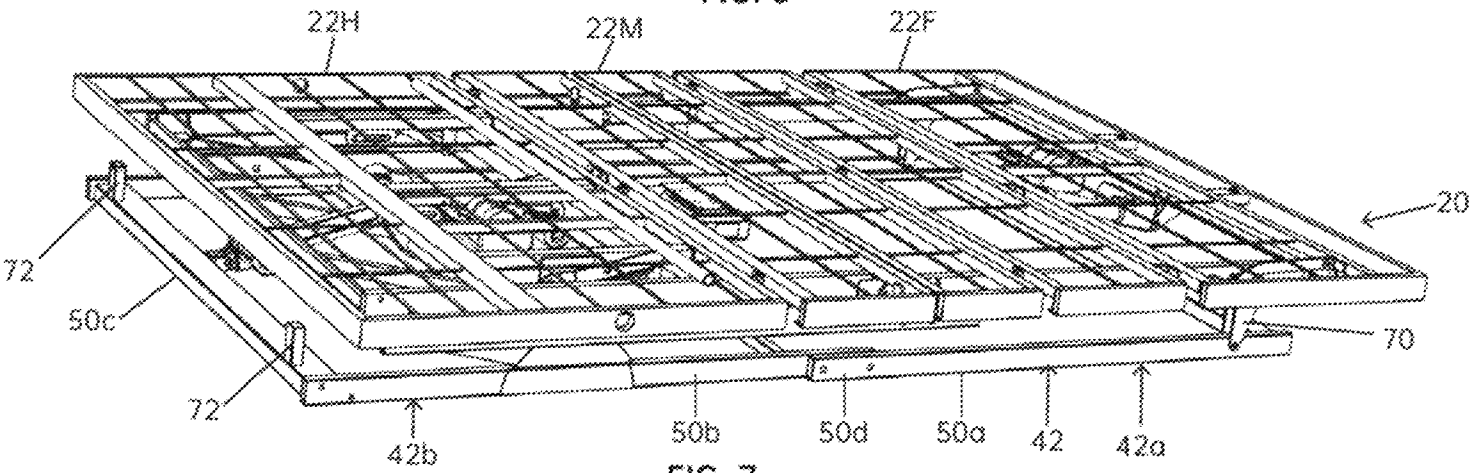
Figure 8:
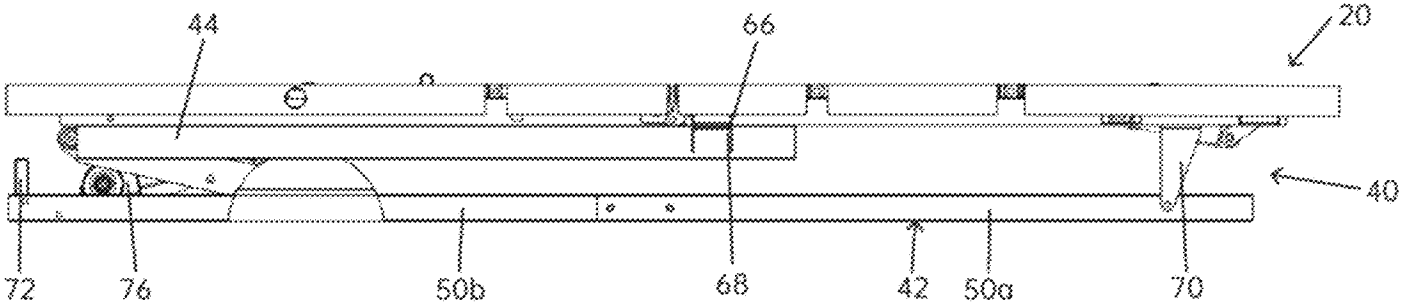
FIGS. 8-10 are side, foot, and head elevational views of the bed frame in a flat position.
Figure 9:
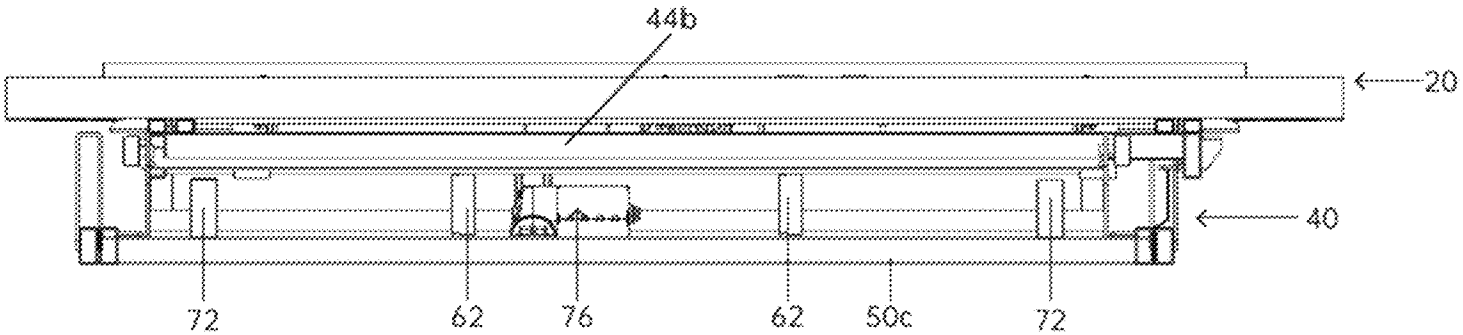
Figure 10:
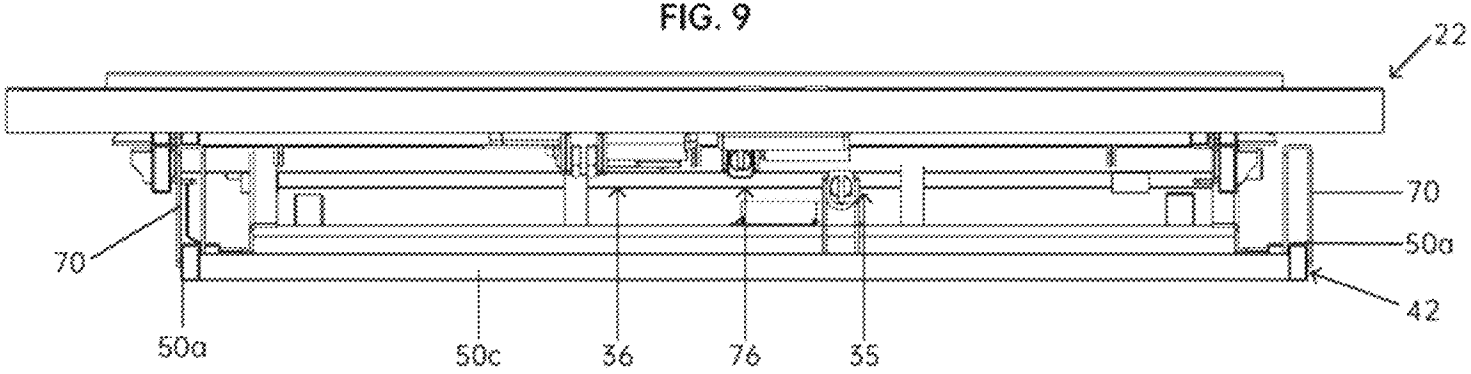

The following detailed description illustrates the claimed invention by way of example and not by way of limitation. This description will clearly enable one skilled in the art to make and use the claimed invention, and describes several embodiments, adaptations, variations, alternatives and uses of the claimed invention, including what I presently believe is the best mode of carrying out the claimed invention. Additionally, it is to be understood that the claimed invention is not limited in its application to the details of construction and the arrangements of components set forth in the following description or illustrated in the drawings. The claimed invention is capable of other embodiments and of being practiced or being carried out in various ways. Also, it is to be understood that the phraseology and terminology used herein is for the purpose of description and should not be regarded as limiting.

A tiltable bed frame 10 is shown generally in FIGS. 1-10, with the bed frame being shown in a raised or tilted position in FIGS. 1-5 and in a lowered or flat position in FIGS. 6-10. The bed frame 10 comprises a mattress support 20 (best shown in FIG. 11) mounted or secured to an elevation kit 40 (shown in FIGS. 12-16). As will be described below, the construction of the elevation kit allows for relatively easy assembly of the elevation kit and of the mattress support to the elevation kit.

Figure 11:
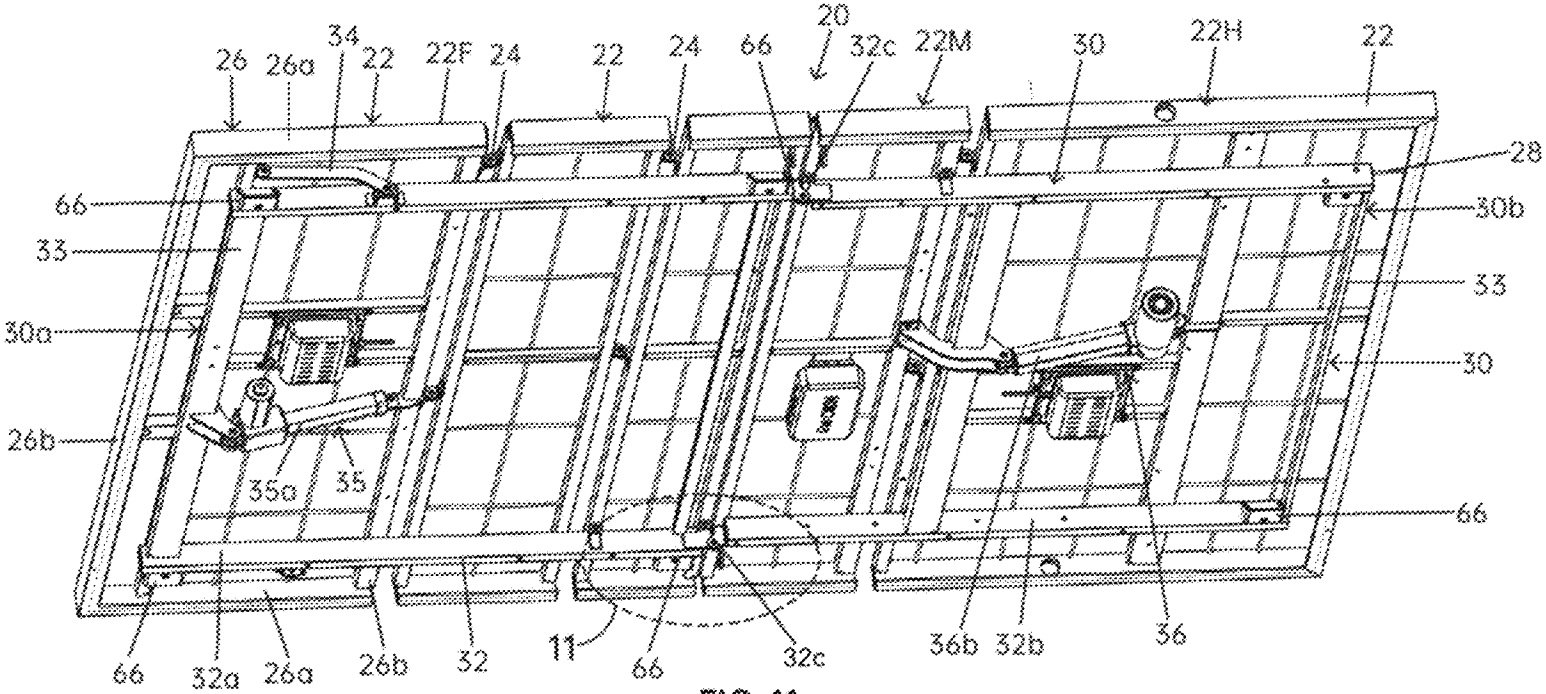
FIG. 11 is a bottom perspective view of the mattress support.

The mattress support 20, shown best in FIG. 11, illustratively comprises discrete sections 22 which are connected together by hinges 24, such that the angular position of the sections relative to each other can be altered. Each section 22 comprises a section frame 26 formed from opposed side members 26*a* and opposed end members 26*b*. The hinges 24 connect adjacent end members 26*a* of adjacent sections 22. Longitudinal and transverse support wires 28 extend between the end members and side members of the support section frames 26. The support wires 28 are generally level or flush with the surface of the section frame 26. The frame 26 and wires 28 thus, in combination, define a surface upon which a mattress can be placed. It will be appreciated that the various sections 22 of the mattress support 20 are all formed in generally the same manner, although, as seen, some may be larger than others. When all the sections 22 are oriented in a common plane, as shown in FIGS. 1-10, the top of the sections will all be co-planar and will define a flat surface (either canted or horizontal, depending on the position of the elevation kit 40). As seen in FIG. 1, one of the sections 22 include a head section 22H positioned at the head of the frame 10, a foot section 22F positioned at the foot of the frame, and a pair of middle sections 22M positioned between the head and foot sections 22H, F. Although two middle sections 22M are shown, the frame could include just one middle section or three or more middle sections, as desired.

Figure 11A:
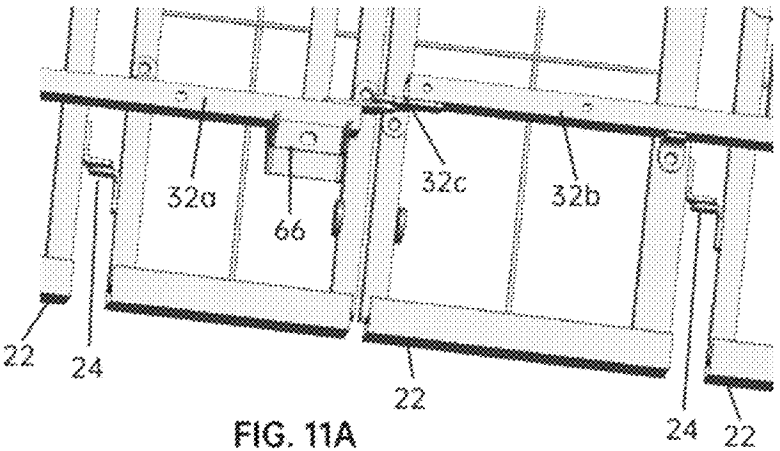
FIG. 11A is an enlarged fragmentary view of the mattress support taken along circle 11 of FIG. 11.

The mattress support sections 22 sit atop a mattress support frame 30. The mattress support frame comprised of opposed side members 32 and opposed end members 33. If desired, the side members 32 can be formed from two pieces 32*a,b*, each of which is approximately one-half the length of the complete side member 32. The two side members 32*a,b* are then connected together by a pivot joint 32*c*. The pivot joint 32*c* and the hinges 24 are shown in FIG. 11 without their respective a pivot or hinge pins for purposes of clarity. By forming the side members 32 from two pieces, the support frame 30 essentially comprises foot portion 30*a* and a head portion 30*b*, each of which is generally U-shaped, with the two portions being pivotally connected together at the pivot joint 32C. As seen in FIG. 11A, the side members 32*a,b* are axially offset from each other by the width of the pivot joint 32C. Further, the support section 22 that spans the pivot joint 32C is actually formed of two half sections, such that this section is effectively split above the pivot junction 32C. This allows for the support frame 30 (and the mattress support 20) to be folded in half.

The mattress support frame 30 is smaller in width than the support sections 22 and is shorter than the combined length of the support sections 22. The foot support section 22F is connected to the frame 30 by means of linkages 34 which extend between a side member 26*a* of the section 22 and the side members 32*a* of the frame 30. The linkage allows for the angular position of the foot section 22F to be raised or tilted relative to the support frame 30. A foot end drive assembly 35 comprising an extendable/retractable member 35*a* extends between the end member of the foot portion of the frame 30 and an inner end member 26*b* of the foot section 22. The connections at both ends of the drive assembly 34 are pivotal. A head end drive assembly 36 comprising an extendable/retractable member 36*a* is connected between transverse members of a head section 22H of the mattress support 20 and the middle section 22M immediately adjacent the head section. The connections at both ends of the drive assembly 36 to the respective sections 22M,H are pivotal. As can be appreciated, by extending the extendable/retractable members 34*a*, 36*a*, the relative angle of the foot section 22F and head section 22H relative to the support frame 30 can be selectively adjusted. The two extendable/retractable drive assemblies 34, 36 can be motor operated, as shown in FIG. 11. Alternatively, they can be pneumatically or hydraulically operated.

Turning to FIGS. 12-16, the elevation kit 40 comprises a base 42, a tilt member 44, and a lever member 46. The base 42 comprises a foot portion 42*a* and a head portion 42*b* which are joined together by fasteners 48. The fasteners 48 are preferably pins, but could be bolts or screws. The foot and head portions 42*a,b* each comprise opposed side members 50*a,b* and a single end member 50*c*, making each portion generally U-shaped. The combined length of the side members 50*a* is greater than the overall length of the base 42, and the side members 50*a* define an overlap area 50*d* which receives the fasteners 48 to secure the foot and head portions together. The head portion 42*b* additionally includes a cross-member 52 extending between the side members 50*a* near the fasteners 48. As seen, each overlap area 50*d* receives two fasteners 48, for a total of four fasteners holding the base 42 together.

Figure 19:
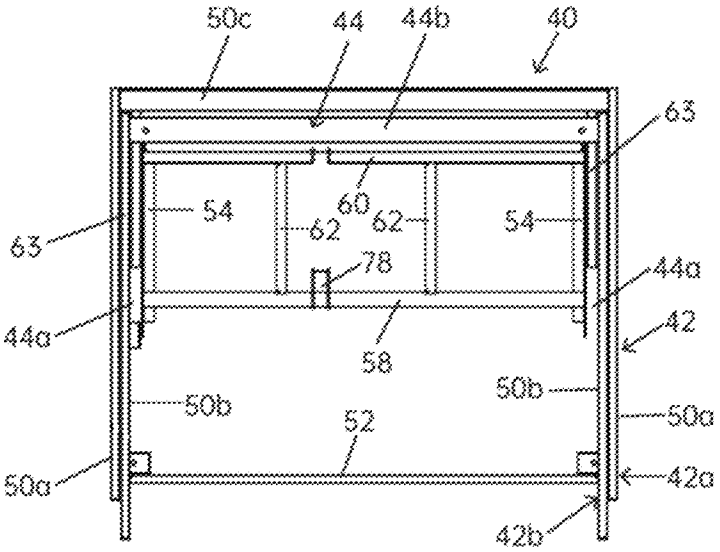
FIG. 19 is a plan view showing the elevation kit in a folded position.

Preferably, one of the fasteners 48 on each side of the base 42 defines a pivot axle, whereby, when the second fasteners are not present, the foot and head portions can pivot relative to each other. The head and foot portions are sized, and the pivot portion is positioned, such that when the head and foot portions are pivoted to a folded position, the head portion nests within (or is surrounded by) the foot portion, as seen in FIG. 19. As described below, the second fastener 48 secures the base 42 in its unfolded position. To this end, the second fastener can be considered a locking element.

The lever member 46 comprises two opposed arms 54 which are pivotally connected at their lower ends to the side member 50*b* of the base head portion 42*b*. The base head portion 42*b* can include a mounting members 56 secured to the inner surfaces of the base head portion side members 50*b*. These mounting members can, for example, be made from square tubing, which is, for example, welded to the side members 50*b*. An axle or pin (not shown) can extend through each arm 54 into their respective mounting member 56. A lower transverse member 58 (shown to be generally cylindrical) extends between the lever member arms 54 proximate the fixed end of the arms. A second, upper transverse member 60 (which can be formed from square stock) extends between the arms 54 at their upper ends. A pair of longitudinal members 62 extend between the upper and lower transverse members 58, 60.

Figure 12:
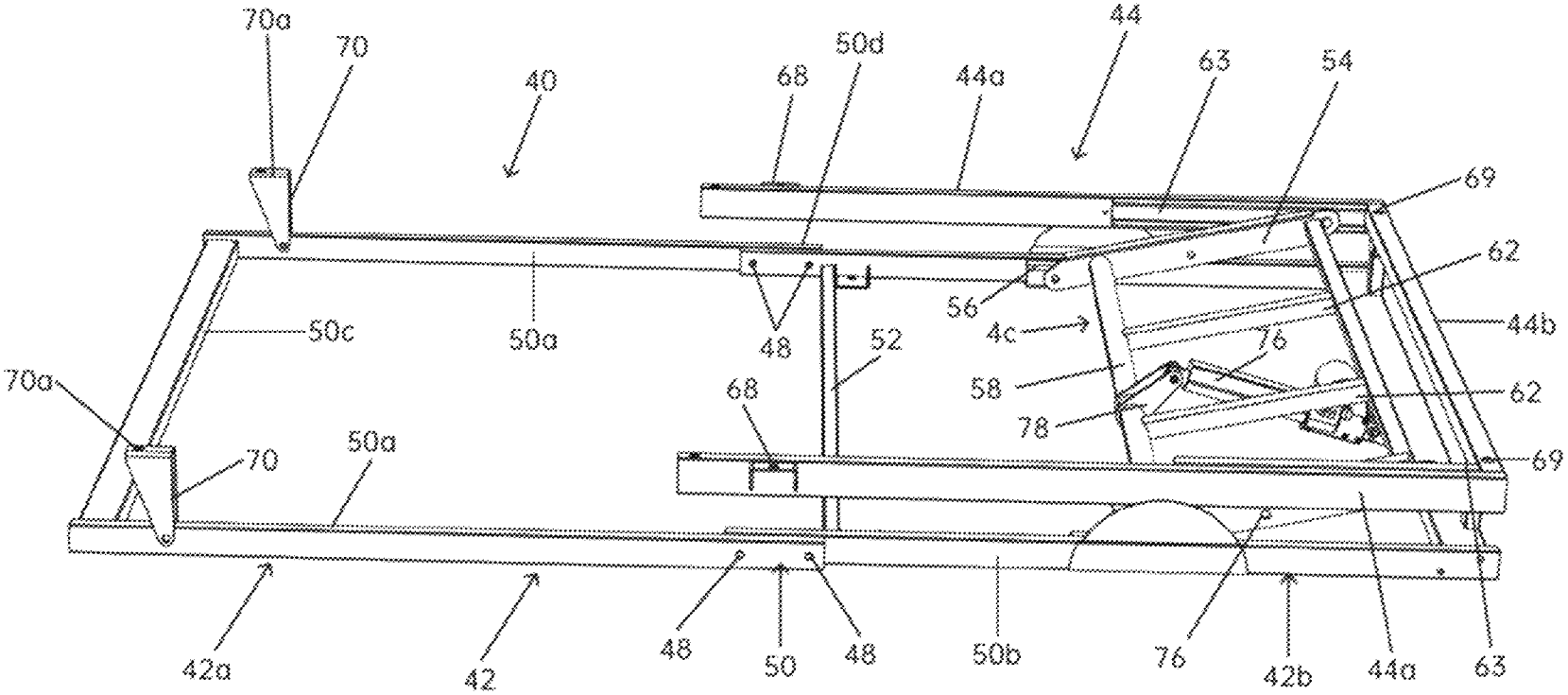
FIG. 12 is a top perspective view of the elevation kit.
Figure 13:
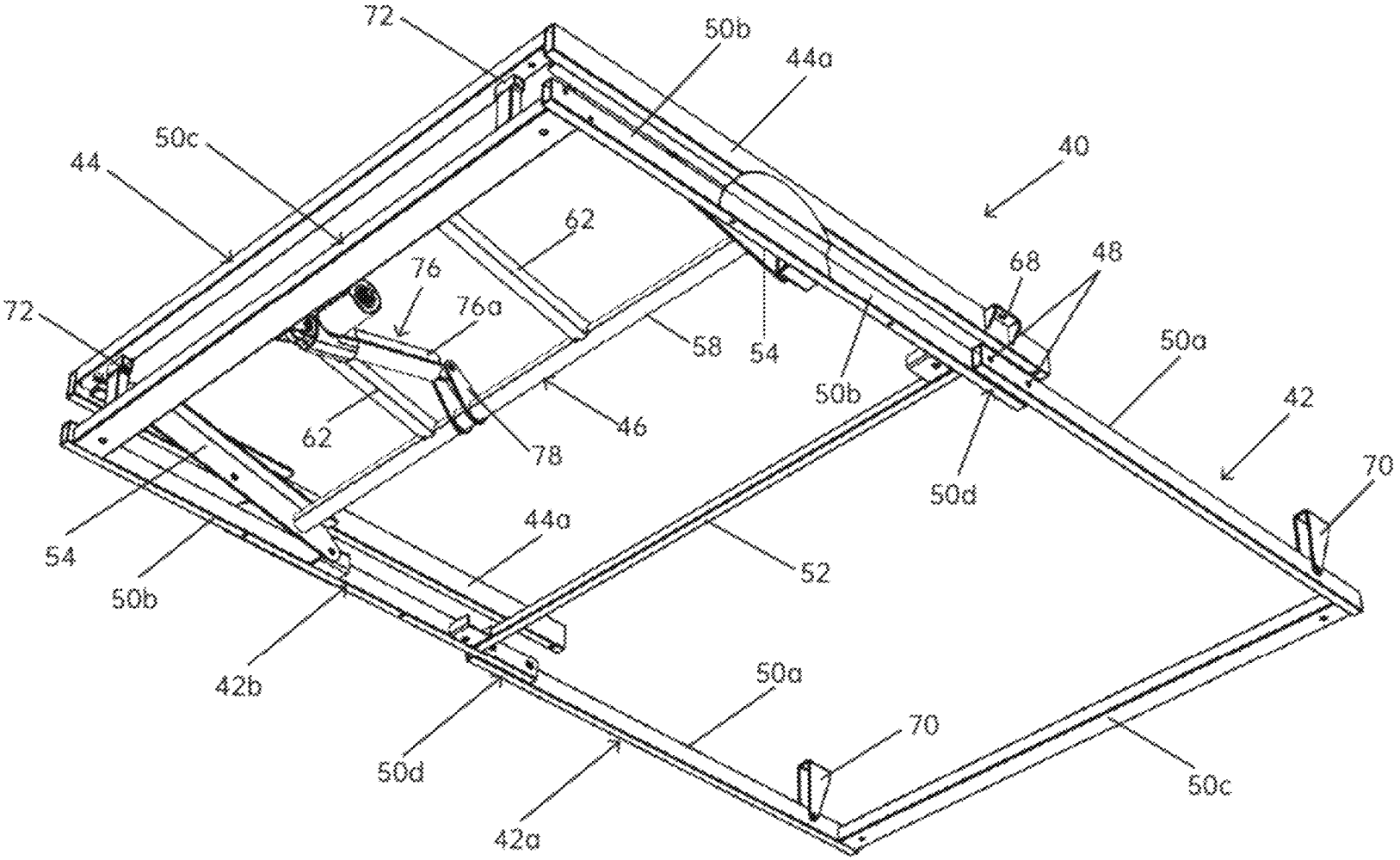
FIG. 13 is a bottom perspective view of the elevation kit.
Figure 14:
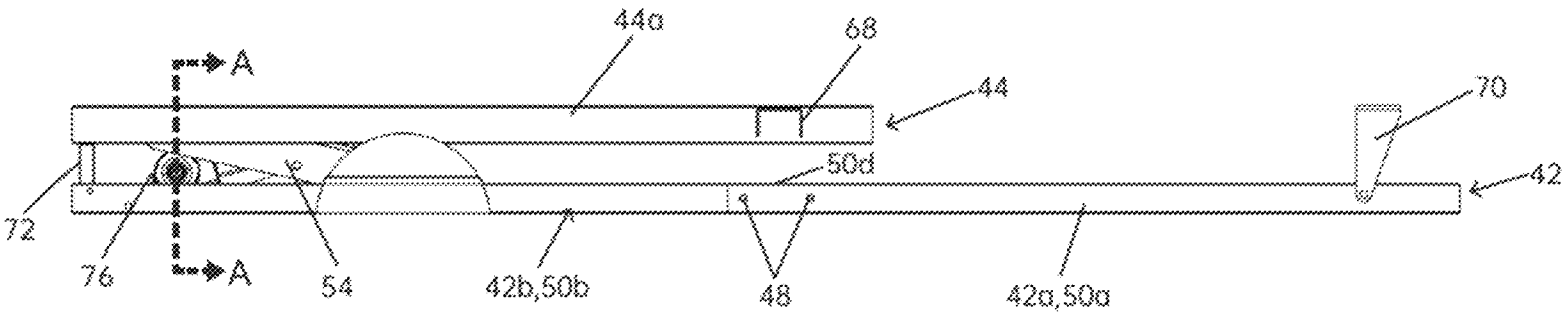
FIG. 14 is a side elevational view of the elevation kit.
Figure 15:
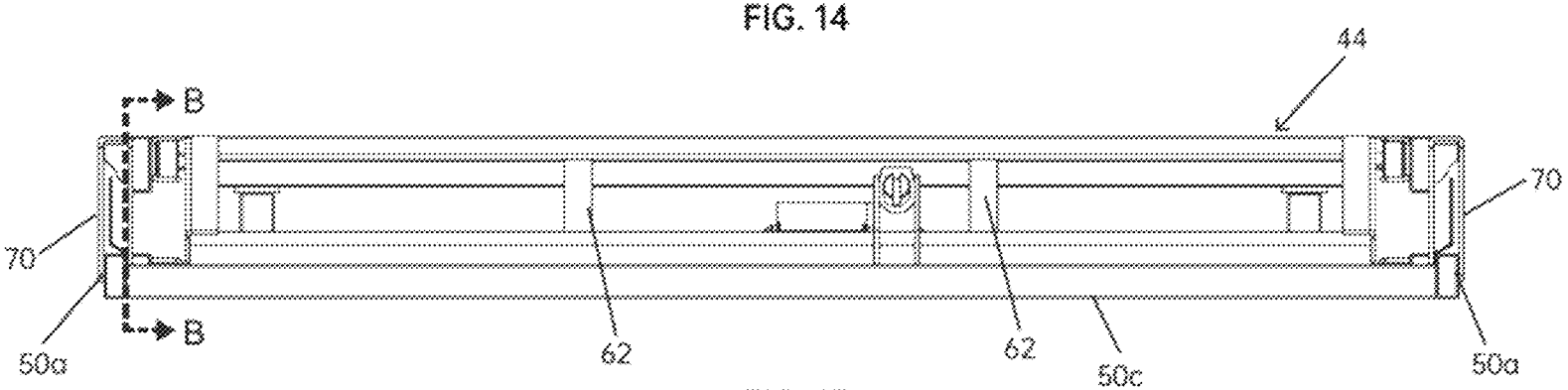
FIGS. 15 and 16 are rear (or foot) and front (or head) end views of the elevation kit.
Figure 16:
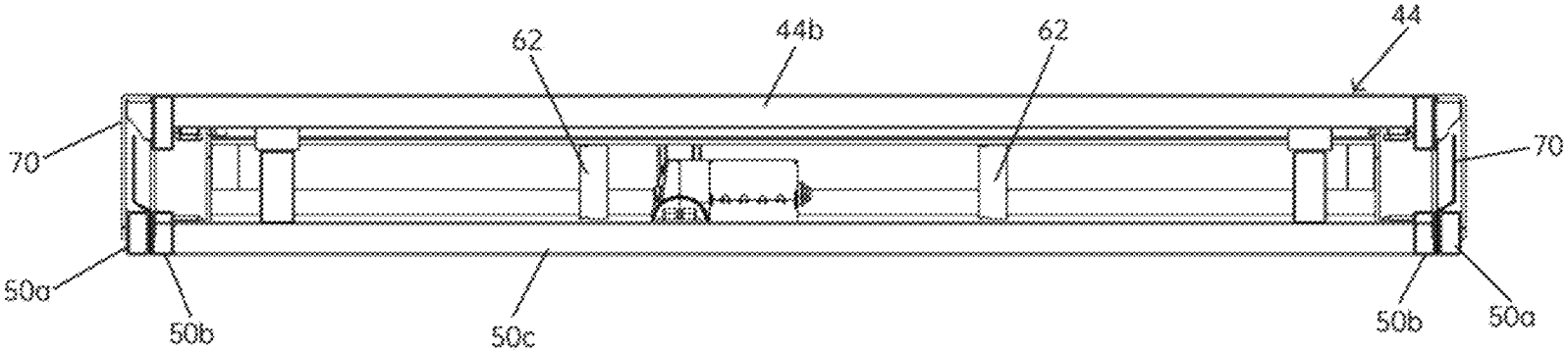
Figure 17:
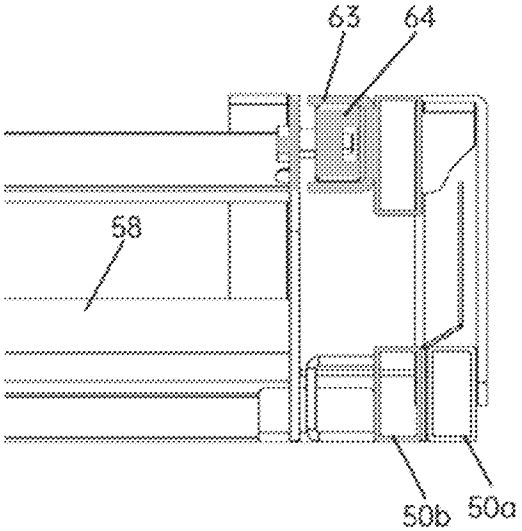
FIG. 17 is a fragmentary cross-sectional view taken along line A-A of FIG. 14.
Figure 18:
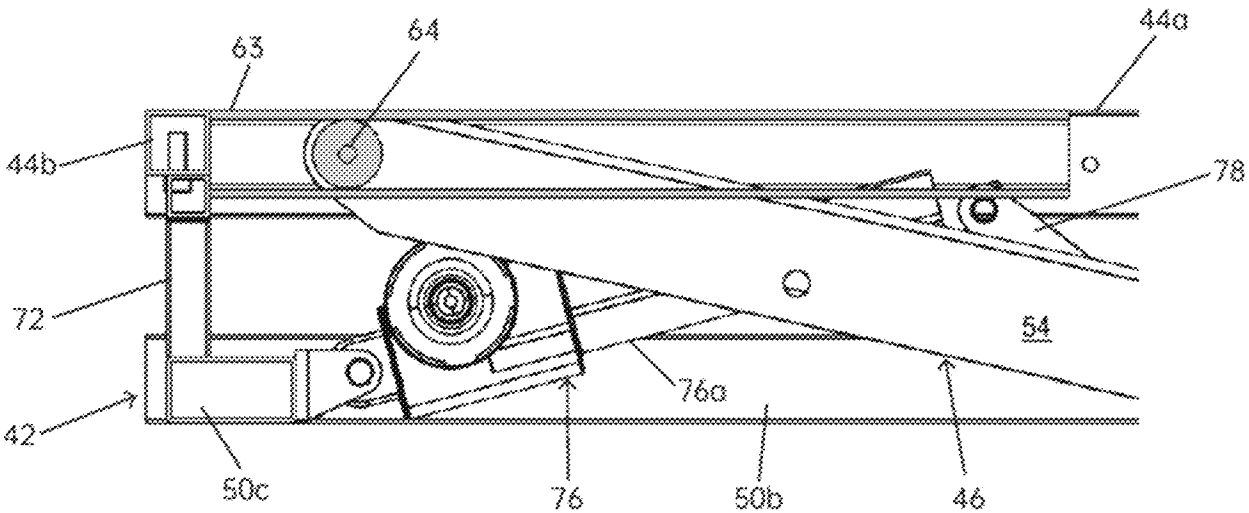
FIG. 18 is a fragmentary cross-sectional view taken along line B-B of FIG. 15 and is taken perpendicularly to the cross-sectional view of FIG. 17.
Figure 20:
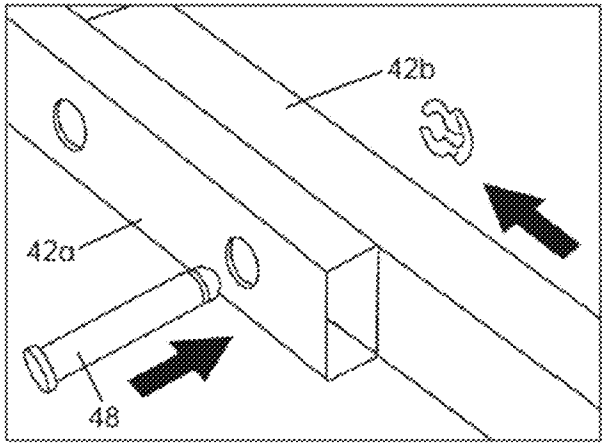
FIG. 20 is an enlarged fragmentary view showing a step of connecting side members of a base of the elevation kit.

The tilt member 44 comprises two opposed side members or arms 44*a* and an end member 44*b*. As seen, the tilt member arms 44*a* are shorter than the overall length of the base 42, and preferably have a length generally equal to the length of the base head portion side members 50*b*. The tilt member 44 is open at its end opposite the head of the frame 10. Inwardly opening tracks 63 extend rearwardly on each side arm 44*a* from the end member 44*b*. Rollers 64 are rotatably mounted to the upper or free end of the [tilt] lever member arms 54. These rollers 64 are then received in the tracks 63. As can be appreciated, with the rollers 64 received in the tracks 63, the angular orientation of the tilt member 44 can vary relative to the lever member 46 and to the base 42. Further, the lever member arms 54 can travel along the track, to allow the longitudinal position of the lever member arms 54 to vary relative to the tilt member 44. As seen in FIG. 12, the tilt member arms are not connected directly to the base 42. Rather, the lever member 46 defines the connection between the tilt member 44 and the base 42.

Figure 22B:
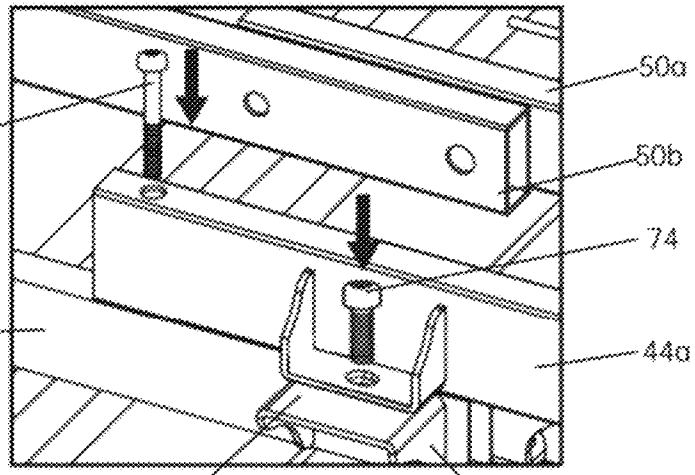
FIGS. 22A-C show steps of securing the mattress support to the elevation kit to complete assembly of the bed frame, the bed frame being shown in an upside down position (with the mattress support at the bottom of the images).
Figure 22A:
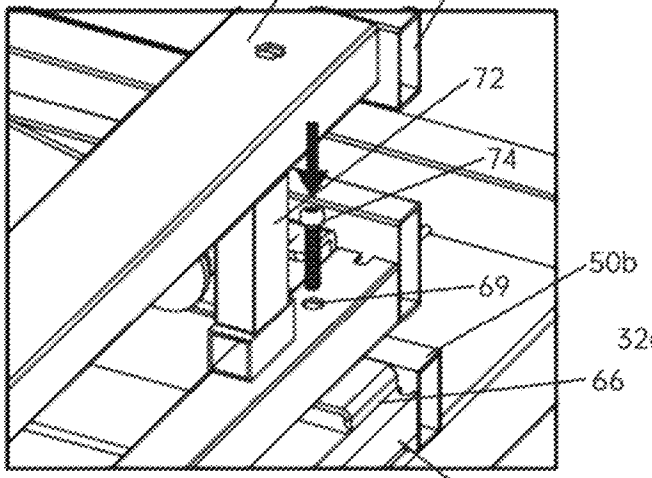
Figure 22C:
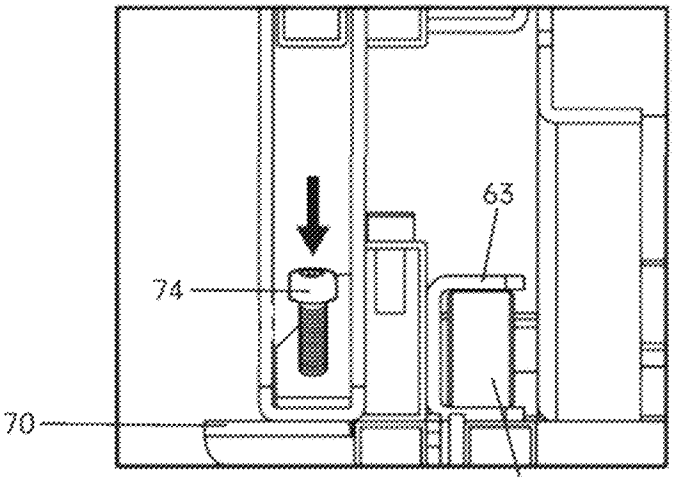

The mattress support 20 rests upon, and is connected to, the elevation kit 40. The mattress support frame 30 includes mounting ears 66. The elevation kit includes mounting ears 68 positioned proximate free ends of the side members 44*a* of the tiltable member. Mounting holes 69 are formed in the end member 44*b* of the tiltable member. Lastly, legs 70 are pivotally connected to the side members 50*a* pf the base foot portion 42*a* proximate the end member 50*c*. The legs 70 are shown to be generally triangular, but could be square or rectangular. The legs 70 each include a mounting hole 70*a* in a top surface of the leg. The mounting ears 66 of the mattress support frame 30 line up with mounting ears 68, and mounting holes 69, 70*c* of the elevation kit, and is connected to the elevation kit by, for example, fasteners, such as bolts 71, as shown in FIGS. 22A-C. The elevation kit, lastly, includes stand-offs 72 extending upwardly from the end member 50*c* of the head portion 42*b* of the base 42. The stand-offs 72 have a total height generally equal to the height of the legs 70, such that when the frame is in its lowered position, a seen in FIGS. 6-10, the head end of the mattress support will rest upon the uprights 70.

As can be appreciated, by raising and lowering the lever member 46, the angle of the tilt member 44, and thus of the mattress support 20 relative to the base 42 will be adjusted. A third drive assembly 76 comprising a third extendable/retractable member 76*a* is pivotally connected at one end to an arm 78 fixed to, and extending from, the transverse member 58 extending between the arms 54 of the tilt member 46. The arm 78 is positionally fixed relative to the transverse member 58. Thus, by altering the length (extending or retracting) the extendable/retractable member 76*a*, the angle of the lever member 76 relative to the base is changed, thereby changing the angle or degree of tile of the tilt member 44 and of the mattress support 20.

The extendable/retractable members 35*a*, 36*a*, and 76*a* of the drive assemblies 35, 36, and 76 each comprise an outer tube and an inner tube or rod which can move axially relative to each other. The inner tube or rod can be moved axially relative to the outer tube in any desired manner. In the preferred embodiment, electric motors are utilized. The electric motors, for example, drive a rack and pinion system. Alternatively, there can be a threaded connection between the outer tube and the inner tube or rod, and the motor can cause one to rotate relative to the other to thereby extend and retract the inner tube or rod relative to the outer tube. In another alternative, the extendable/retractable drive assemblies can be pneumatically or hydraulically driven. In any event, the frame 10 includes a controller C which can independently drive each of the drive assemblies, thereby allowing a user to adjust the overall position or angle of the mattress support 20 and the relative angular position of the head and foot section 22H,F of the mattress support 20.

Figure 21:
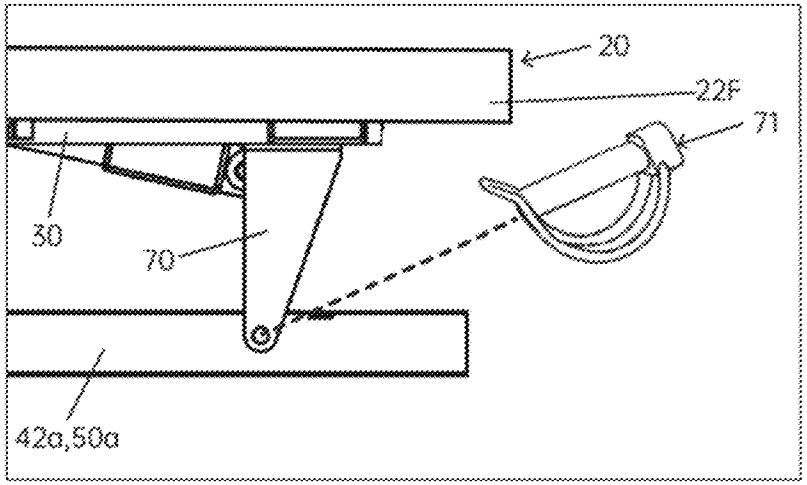
FIG. 21 is an enlarged fragmentary view showing a step of connecting a leg to a foot end of the base and the mattress support to the leg.

As alluded to above, the construction of the bed frame 10 allows the bed frame to be delivered to a customer in a manner that allows for relatively easy assembly by the customer. The base 42 of the elevation kit 40, as noted, is secured together by four fasteners—two fasteners in each of the overlap areas 50*d* of the side members 50*a,b*. The base can be provided with one fastener 48 in overlap area 50*d*, allowing for the elevation kit to be delivered in a "folded" fashion. Thus, elevation kit 40 can be delivered with base head portion 42*b* fully assembled. That is, the fixed ends of the lever member arms 54 are pivotally connected to the side members 50*a* of the base member head portion 42*b*, and the rollers of the lever member arms are received in the track 63 of the side members 44*a* of the tilt member 44. The foot portion 42*a* of the base can be folded over relative to the base head portion, such that the foot portion 42*a* effectively surrounds the head portion 42*b*. In this manner, the customer then need only unfold the base 42 and insert the second fasteners 48 on each side of the base. The legs 70 can then be pivotally secured to the foot of the base 42 using a pin 71 which passes through a bottom end of the leg 70 into the side member 50*a* of the base foot portion 42*a* (FIG. 21).

Similarly, the mattress support 20 can be delivered in a folded position. After the base 42 has been unfolded and the second fastener has been inserted int eh in the base to secure the base in its unfolded position, the mattress support can be unfolded and positioned over the elevation kit 40. The mounting ears 66 of the support frame 30 are aligned with the mounting ears 68 and the respective mounting holes 69 and 70*a*. In this position, the support frame 30 of the mattress support 20 will rest on the tilt member 44 and the legs 70. Bolts 74 are then passed through the aligned bolt holes to secure the mattress support 20 to the elevation kit 40. Additionally, a pair of bolts 76 pass through the side members 44*a* of the tilt member into the side member 32*a* of the support frame 30 to further secure the mattress support 20 to the elevation kit 40. In this manner, the bed frame 10 can be assembled from its folded delivered condition to an unfolded assembled condition using 2 pins and 6 bolts.

Once the bed frame is assembled, the drive assembly 76 can be secured in place on the elevation kit 40. The drive assemblies 35, 36 are preferably preassembled to the mattress support, and thus, the customer need not assembly them to the mattress support. With the drive assemblies in place, the drive assemblies can them be placed in communication with the controller C by connecting cables (not shown) between the drive assembly motors and the controller.

As can be appreciated, a tiltable bed frame has been provided which can be easily assembled by a customer.

Although the mattress support 20 is disclosed to be an adjustable mattress support. It will be apparent that the elevation kit 40 can be used in conjunction with most any type of mattress support, including a non-adjustable mattress support.

As various changes could be made in the above constructions without departing from the scope of the invention, it is intended that all matter contained in the above description or shown in the accompanying drawings shall be interpreted as illustrative and not in a limiting sense. For example, although two fasteners 48 in the form of pins of are provided to secure the head and foot portions of the base 42 together, the elevation kit could replace the second fastener/pin of each side of the base 42 with, for example, a spring button on the side members of, for example, the head portion which is received in a hole in the foot portion. In this variation, the customer would not need to insert the second fastener/pin to secure the base 42 in the unfolded position. Rather, the spring button would snap into place as the base is unfolded to hold the base 42 in the unfolded position. This example is merely illustrative.

The invention claimed is:

1. A tiltable bed frame comprising an elevation kit and a mattress support fixed to the elevation kit;

the mattress support adapted to support a mattress; the mattress support comprising a frame having a opposed sides and opposed ends and which is configured, when fixed to the elevation kit to be generally planar;

the elevation kit being movable between a flat position in which the mattress support is generally horizontal and a raised position in which the mattress support is canted from a first end to a second end; the elevation kit comprising:

a base comprised of a head portion and a foot portion, the head and foot portions each comprising an end member and opposed side members such that the head and foot portions are generally U-shaped; the side members of the head and foot portions overlap each other at respective ends thereof to define an overlap area of the base, a fastener extending through the side members of the foot and head portions to pivotally connect the foot and head portions together, said fastener defining a pivot axle for said base, whereby the base is capable of being folded in a position wherein one of the head and foot portions nests within the other of the head and foot portions;

a locking element which is adapted to secure the base in an unfolded position in which the side members of said foot and head portions of said base are generally parallel and in generally the same plane;

a lever member, said lever member comprising opposed lever arms and first and second transverse members extending between said opposed lever arms and spaced from each other along said opposed lever arms; said lever arms being pivotally connected at a bottom end to said side members of said base head portion between the end member of said base head portion and the overlap area of said base; said lever member including a roller proximate a free end of each arm;

a tilt member comprising a pair of opposed tilt member arms and an end member extending between said tilt member arms at a head end of said tilt member arms; said mattress support frame being secured to said tilt member arms; said tilt member arms being shorter than the overall length of said base; each arm including an inwardly facing track extending rearwardly from said tilt member end member; said rollers of said lever member being received in said tracks; and a drive assembly comprising an extendable/retractable member; said drive assembly being pivotally connected at a first end to said base and being pivotally connected at a second end to said tilt member; whereby, activation of said drive assembly causes a length of said extendable/retractable member to alter thereby adjusting an angular position between said tilt member and said base.

2. The elevation kit of claim 1 wherein said locking member comprises a pin which extends through the side members of said head and foot portions of said base in the overlap area.

3. The elevation kit of claim 1 wherein said tilt member arms are approximately equal in length to the length of said side members of said base head portion.

4. The elevation kit of claim 1 wherein said drive assembly is pivotally connected at said first end to said end member of said head portion and is pivotally connected at said second end to said first transverse member of lever tilt member.

5. The elevation kit of claim 4 including a lever arm extending from said first transverse member; said send end of said drive assembly being pivotally connected to said lever arm.

6. The tiltable bed frame of claim 1 wherein said tilt member arms are elongate, said mattress support frame being secured to said tilt member arms such that a first end of said tilt member arms is proximate a first end of said mattress support and said tilt member arms extend away from said first end of said mattress support.

7. A tiltable bed frame comprising an elevation kit and a mattress support member adapted to be secured to the elevation kit; the elevation kit being movable between a flat position in which the mattress support is generally horizontal and a raised position in which the mattress support is canted from a first end to a second end;

the elevation kit comprising:

a base comprised of a head portion and a foot portion, the head and foot portions each comprising an end member and opposed side members such that the head and foot portions are generally U-shaped; the side members of the head and foot portions overlap each other at respective ends thereof to define an overlap area of the base, a fastener extending through the side members of the foot and head portions to pivotally connect the foot and head portions together, said fastener defining a pivot axle for said base, whereby the base is capable of being folded in a position wherein one of the head and foot portions nests within the other of the head and foot portions;

a locking element which is adapted to secure the base in an unfolded position in which the side members of said foot and head portions of said base are generally parallel and in generally the same plane;

a lever member, said lever member comprising opposed lever arms and first and second transverse members extending between said opposed lever arms and spaced from each other along said opposed lever arms; said lever arms being pivotally connected at a bottom end to said side members of said base head portion between the end member of said base head portion and the overlap area of said base; said lever member including a roller proximate a free end of each arm;

a tilt member comprising a pair of opposed tilt member arms and an end member extending between said tilt member arms at a head end of said tilt member arms; said tilt member arms being shorter than the overall length of said base; each arm including an inwardly facing track extending rearwardly from said tilt member end member; said rollers of said lever member being received in said tracks; and a drive assembly comprising an extendable/retractable member; said drive assembly being pivotally connected at a first end to said base and being pivotally connected at a second end to said tilt member; whereby, activation of said drive assembly causes a length of said extendable/retractable member to alter thereby adjusting an angular position between said tilt member and said base;

wherein said mattress support member is adjustable; said mattress support member comprising:

a mattress support frame; said mattress support frame comprising a head portion and a foot portion which are pivotally connected, whereby the head and foot portion of said mattress support frame can be pivoted about a pivot axis between a folded position and an open position; and at least a mattress support head section and a mattress support foot section, said mattress support head section being positioned over said head portion of said mattress support frame and said mattress support foot section being positioned over said foot portion of said mattress support frame; said mattress support head and foot sections defining a surface adapted to support a mattress.

8. The tiltable bed frame of claim 7 wherein at least one of said mattress support head and foot sections are adapted to be pivotal between a position in which it is generally parallel to said support frame and a position in which it is angled relative to said support frame.

9. The tiltable bed frame of claim 7 wherein at least one of said mattress support head and foot sections is shorter than its respective head and foot portion of the support frame; said support member further comprising a mattress support middle section positioned between said mattress support head and foot sections such that said mattress support middle section does not extend over said pivot axis.

* * * * *